US007740782B2

(12) United States Patent
Ou

(10) Patent No.: US 7,740,782 B2
(45) Date of Patent: Jun. 22, 2010

(54) MOLDED SPORTSBALL WITHOUT MOLDING MARK AND MANUFACTURING METHOD THEREOF

(76) Inventor: Tsing Ming Ou, 6F-3, No. 182, Chung Cheng 2nd Rd, Kaohsiung (TW)

( * ) Notice: Subject to any disclaimer, the term of this patent is extended or adjusted under 35 U.S.C. 154(b) by 253 days.

(21) Appl. No.: 11/824,864

(22) Filed: Jul. 2, 2007

(65) Prior Publication Data

US 2009/0011878 A1 Jan. 8, 2009

(51) Int. Cl.

| | |
|---|---|
| ***B28B 5/00*** | (2006.01) |
| ***B29C 63/00*** | (2006.01) |
| ***B29C 65/00*** | (2006.01) |
| ***B29C 69/00*** | (2006.01) |
| ***B29C 45/14*** | (2006.01) |
| ***B29B 13/00*** | (2006.01) |

(52) U.S. Cl. ..... 264/241; 264/259; 264/267; 264/271.1

(58) Field of Classification Search ..... 264/240–279; 425/111–112, 116, 123

See application file for complete search history.

(56) References Cited

U.S. PATENT DOCUMENTS

| | | | | | |
|---|---|---|---|---|---|
| 4,239,568 | A | * | 12/1980 | Takazawa | 156/155 |
| 5,320,345 | A | * | 6/1994 | Lai et al. | 473/601 |
| 5,931,752 | A | * | 8/1999 | Guenther et al. | 473/597 |

* cited by examiner

*Primary Examiner*—Khanh Nguyen
*Assistant Examiner*—Matthew Hoover
(74) *Attorney, Agent, or Firm*—Raymond Y. Chan; David and Raymond Patent Firm

(57) ABSTRACT

A sportsball includes a ball carcass having an air cavity therein, wherein the ball carcass includes two ball shells, each of the ball shells having an outer surface, a plurality of channels indented on the outer surface to form a plurality of panel contours thereon, and a contouring edge defining a starting point at one of the channels to continuously extend from the channel to another the adjacent channel until the contouring edge is extended back to the starting point, wherein the two ball shells are integrally bonded with each other to form the ball carcass that the contouring edges of the ball shells are alignedly linked to form a common edge of the ball carcass, such that the common edge of the ball carcass, which is a molding line thereof, also forms as the channels of the ball carcass to invisible the molding line thereat.

13 Claims, 6 Drawing Sheets

MOLDED SPORTSBALL WITHOUT MOLDING MARK AND MANUFACTURING METHOD THEREOF

BACKGROUND OF THE PRESENT INVENTION

1. Field of Invention

The present invention relates to a molded sportsball, and more particularly to a molded sportsball with hidden molding mark and manufacturing method thereof.

2. Description of Related Arts

With rapid development of the society, people spend more and more time at work and sometimes ignore the importance of their own health. In order to have a balance life between work and health, consistent and continuous exercise is necessary for people in modern societies. Among various forms of exercise, ball games are most popular because they are of wide diversities, easy to learn, and entertaining when a group of people play together.

While more and more people participate in ball games, their demands of the quality of sportsballs have been increasing. Sportsballs not only need to be more durable on the outer covering, but also need to possess aesthetic values with attractive appearance.

Generally speaking, a sportsball such as soccer ball or volleyball comprises two parts: an inflatable bladder and an outer covering. In conventional manufacturing process of sportsballs, such as soccer balls, the inner bladder can be made from either natural or synthetic rubber. The raw material is gently heated and forced into a mold, where it forms a balloon. As the material cools, it wrinkles so workers would remove the bladders and partially inflate them to smooth them out.

With respect to the outer covering, it is conventionally made by two identical hemispheric ball shells with smooth and continuous edges. Each hemispheric ball shell is made in a hemispheric mold with a smooth and continuous edge corresponding to that of the hemispheric ball shell. An air cavity is created when two hemispheric ball shells are put together in the mold and the inflatable bladder is placed therein. After the lamination process in which two identical hemisphere molds are engaged with each other edge-to-edge, the sportsball is formed.

The conventional sportsball manufacturing process suffers from its own limitation from aesthetic points of view. The outer covering of the sportsball is made by two hemispheric ball shells with smooth and continuous edges which form a common edge surrounding the center part of the ball. Accordingly, the common edge is an equator of the ball. The common edge, namely the molding mark is obvious on the surface of the sportsball so that the aesthetic value thereof is significantly harmed.

SUMMARY OF THE PRESENT INVENTION

A main object of the present invention is to provide a sportsball including a ball carcass having an air cavity therein, wherein the molding line of the ball carcass forms along the channels of the ball carcass to hide the molding line thereat.

Another object of the present invention is to provide a sportsball, wherein the sportsball has a hidden molding line so that the aesthetic value of the sportsball has been increased and the sportsball becomes more attractive to the customers.

Another object of the present invention is to provide a sportsball, wherein the sportsball can be a soccer ball, volleyball, basketball, football or a ball carcass with any feature thereon based on customer's desire.

Another object of the present invention is to provide a sportsball, wherein the manufacturing process is simple and the manufacturing costs are low so that the sportsball is more affordable to customers.

Another object of the present invention is to provide a method for manufacturing the sportsball, wherein the molding line is formed and hidden along with the channels rather than that surrounding the center part of the ball in conventional manufacturing process.

Accordingly, in order to accomplish the above objects, the present invention provides a sportsball, which comprises a ball carcass having an air cavity therein. The ball carcass comprises two ball shells, wherein each of the ball shells has an outer surface, a plurality of channels indented on the outer surface to form a plurality of panel contours thereon, and a contouring edge defining a starting point at one of the channels to continuously extend from the channel to another said adjacent channel until the contouring edge is extended back to the said starting point. The two ball shells are integrally bonded with each other to form the ball carcass that the contouring edges of the ball shells are alignedly linked to form a common edge of the ball carcass, such that the common edge of the ball carcass, which is a molding line thereof, also forms as the channels of the ball carcass to hide the molding line thereat.

The present invention also provides a method of manufacturing the sportsball, which comprises the steps of:

(a) forming two ball shells, each of the ball shells having an outer surface, a plurality of channels indented on the outer surface to form a plurality of panel contours thereon, and a contouring edge defining a starting point at one of the said channels to continuously extend from the channel o another said adjacent channel until the contouring edge is extended back to the starting point; and (b) integrally bonding the contouring edge of the two ball shells with each other to form a ball carcass having an air cavity therein, wherein the contouring edges of the ball shells are alignedly linked to form a common edge of the ball carcass which is a molding line thereof, and to form as the channels of the ball carcass to hide the molding line thereat.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 6, the embodiments in the present invention are based on a soccer ball. However, the present invention is not limited to the soccer ball, but applied to all sportsballs, such as a volley ball. Moreover, the present invention can be applied to any ball with feature thereon created by its users.

Figure 1:
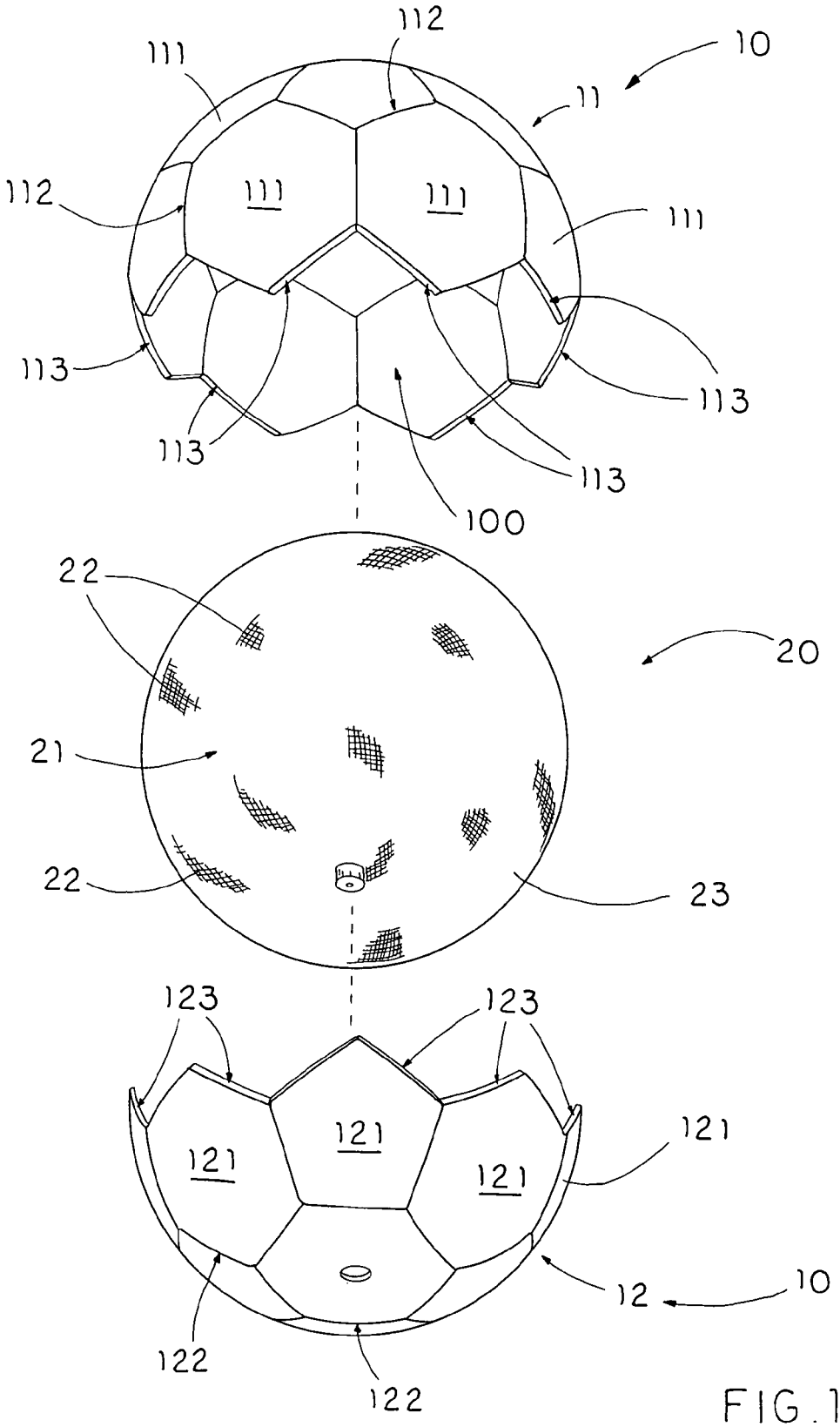
FIG. 1 is an exploded schematic view of a sportsball according to a preferred embodiment of the present invention.
Figure 4:
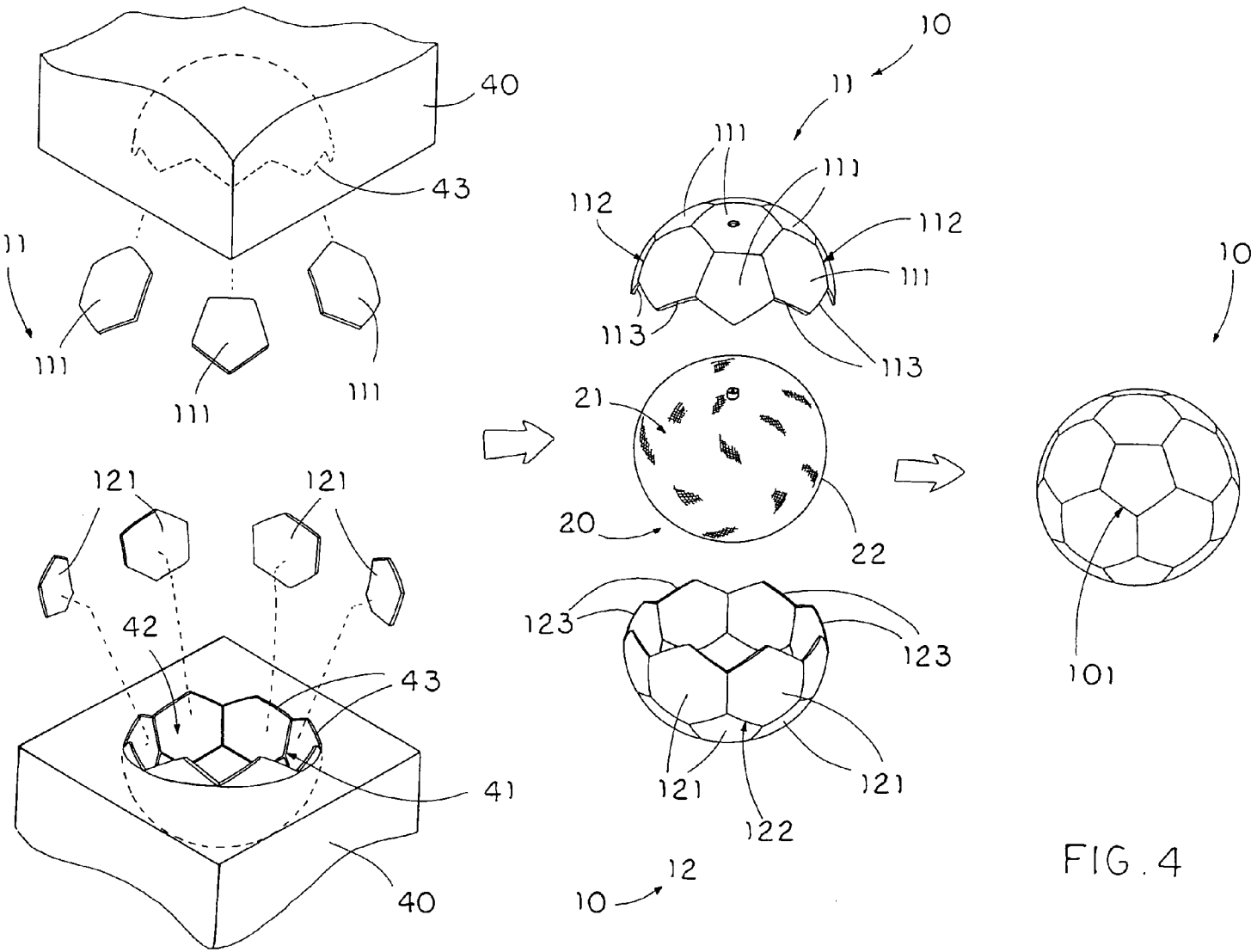
FIG. 4 is a schematic view illustrating the method of manufacturing the sportsball according to the above preferred embodiment of the present invention.

In a preferred embodiment, a sportsball has a ball caress 10 having an air cavity 100 and an inflatable bladder 20, wherein the ball caress 10 comprises two hemisphere ball shells 11, 12 to define the air cavity 100 therewithin. Each of the ball shells 11, 12 has a plurality of panels 111, 121 which are pre-cut in a predetermined shape and are connected with each other edge-to-edge to form the ball shell 11, 12, wherein a plurality of channels 112, 122 are formed between every two neighboring panels 111, 121, as shown in FIG. 1 and FIG. 4. A contouring edge 113, 123 is defined when a starting point at one of the channels 112, 122 to continuously extend from the channel 112, 122 to another adjacent channel 112, 122 until the contouring edge 113, 123 is extended back to the starting point. More specifically, the channels 112, 122 are formed between every two neighboring panels 111, 121 include connecting edges and free edges. Accordingly, the connecting edge of each of the ball panels 111, 121 is defined as an edge to couple with the connecting edge of the neighboring panel 111, 121 while the free edge of each of the ball panels 111, 121 is defined as an edge without coupling with any neighboring panel 111, 121. In other words, the free edges of the ball panels 111, 121 form the contouring edges 113, 123 of the ball shell 11, 12.

The shape of the contouring edge 113, 123 can be designed corresponding to the desire of the user. For soccer ball in the preferred embodiment, the contouring edge 113, 123 is designed based on the shape of the ball panels 111, 121. The inflatable bladder 20 made from either natural or synthetic rubber is disposed in the air cavity 100 created by the two ball shells 11, 12.

Figure 2:
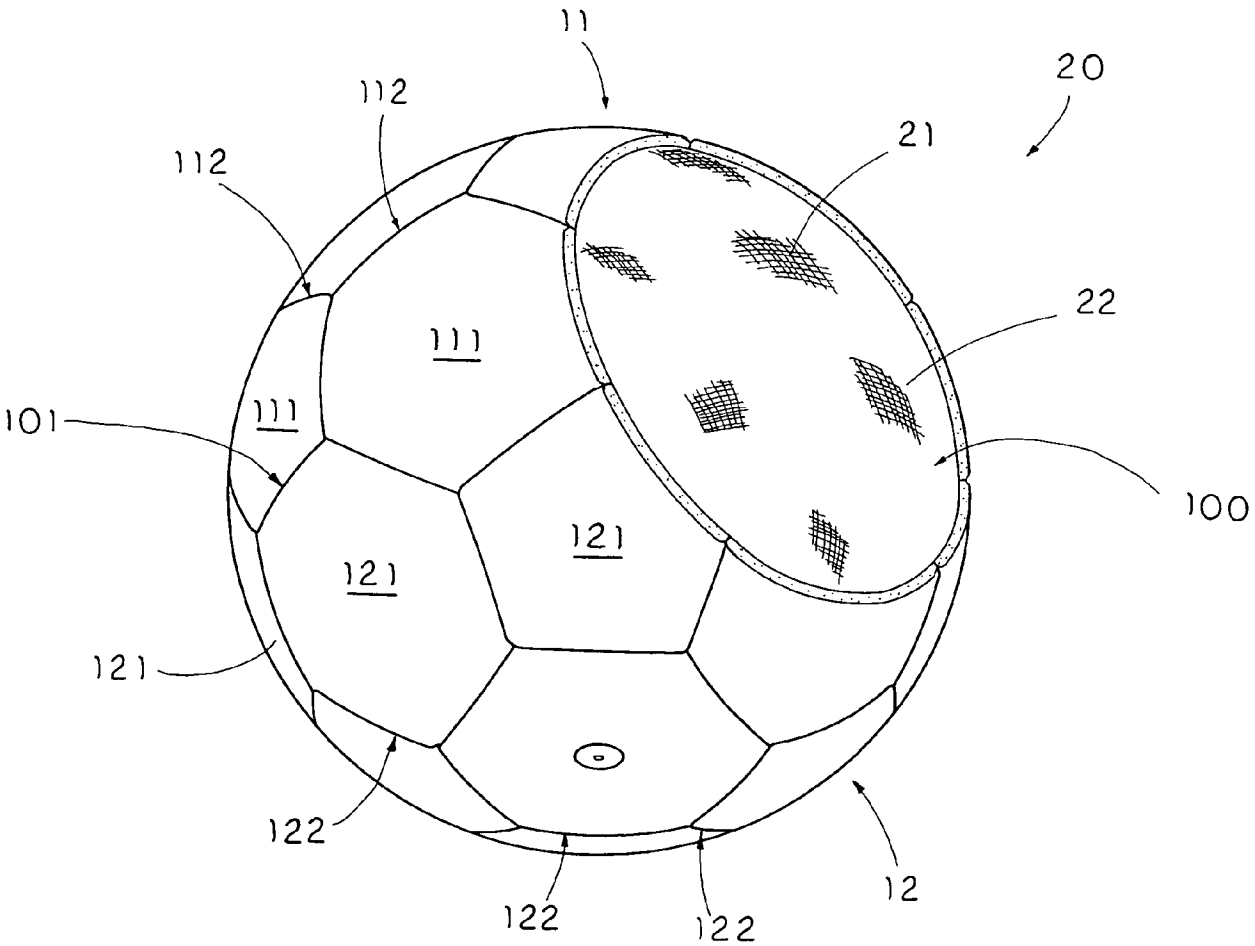
FIG. 2 is a partial sectional view of a sportsball according to the above preferred embodiment of the present invention.

In the preferred embodiment, the inflatable bladder 20 comprises a bladder body 23 for retaining a predetermined amount of air therein and being entirely embraced by a web layer 21. The web layer 21 comprises at least an elongating strengthened thread 22, such as nylon threads, evenly wound around and around the outer surface of the bladder body 23, and thus the strengthened thread 22 is overlapped with each other to form the web layer 21, as shown in FIGS. 1, 2 and 4.

When the ball shells 11, 12 engage together with the inflatable bladder 20 therein, the contouring edges 113, 123 merge and form a common molding line 101, which is among one of the channels 112, 122 existed between every neighboring ball panels 111, 121 so that the common molding line 101 is unobvious so that the appearance of the ball carcass 10 is more attractive and the aesthetic value of the sportsball is increased. In other words, the common molding line 101 is hidden among the existing channels 112, 122.

The sportsball has the common molding line 101 which becomes one of the channels 112, 122 existed between every neighboring panels 111, 121. More specifically, the ball panels are pre-cut in a predetermined shape and put into a molding cup 40 piece by piece and the channels 112, 122 are formed between every neighboring panels 111, 121 after the lamination process, while the common molding line 101 is formed by merging the contouring edges 113, 123, which are both of the shape of panel 111, 121. In other words, the structures of channels 112, 122 and the common molding line 101 are identical, namely they are both formed between neighboring panels 111, 121. Since they are structurally identical, the common molding edge 101 is able to be hidden among the channels 112, 122, as shown in FIG. 2 and FIG. 4.

Figure 3:
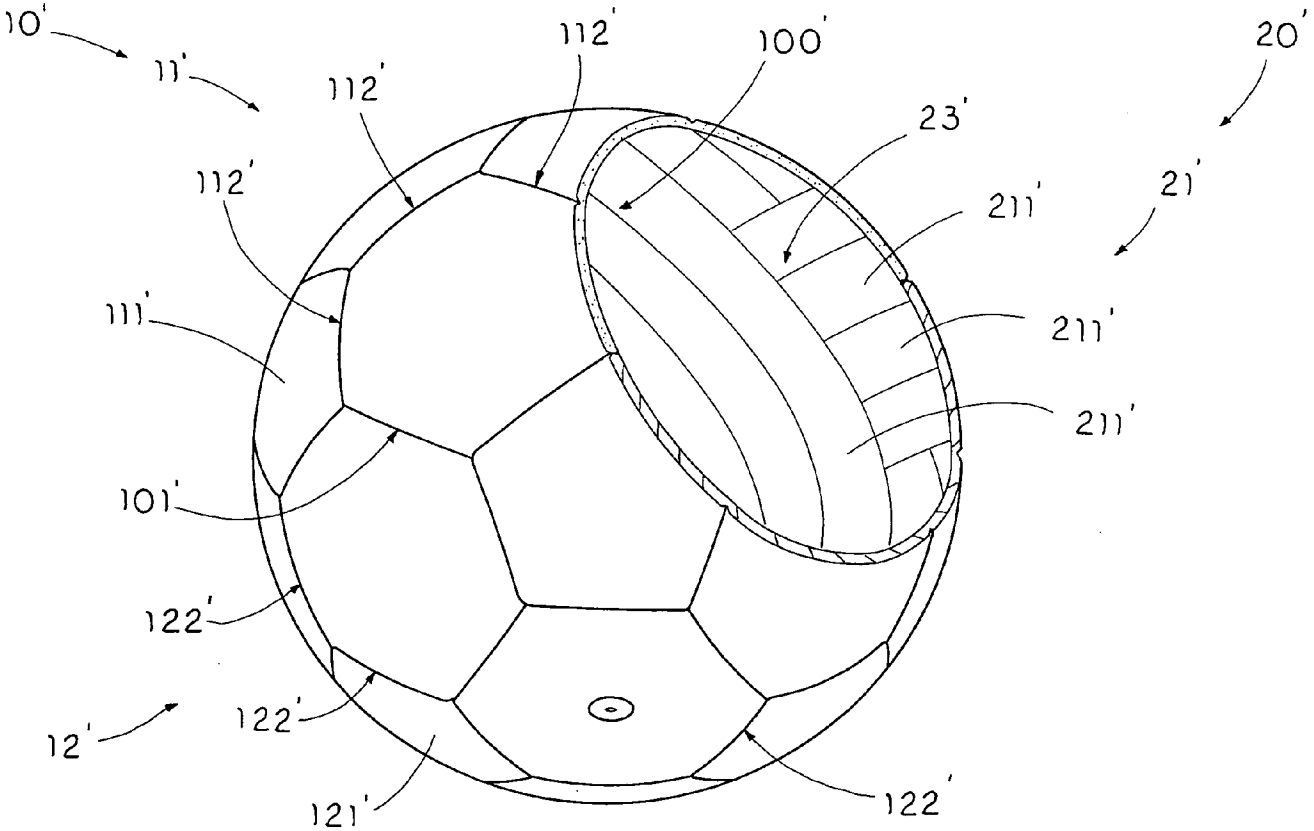
FIG. 3 illustrates an alternative mode of the ball carcass according to the above preferred embodiment of the present invention.

FIG. 3 illustrates an alternative mode of the sportsball, wherein the ball carcass 10' of the sportsball comprises two ball shells 11', 12' which are each made by a continuous hemisphere surface instead of being formed by the panels piece by piece. As shown in FIG. 3, each of the ball shells 11', 12' comprises a sheet of ball panel 111', 121' cut into a predetermined shape to form the contouring edge 113', 123' as a peripheral edge of the ball panel 111', 121', wherein the channels 112', 122' are elongated molding mark formed on a surface of the ball panel 111', 121'. Accordingly, the channels 112', 122' are formed by heat-pressing on the surface of each of the ball panels 111', 121'.

Figure 5:
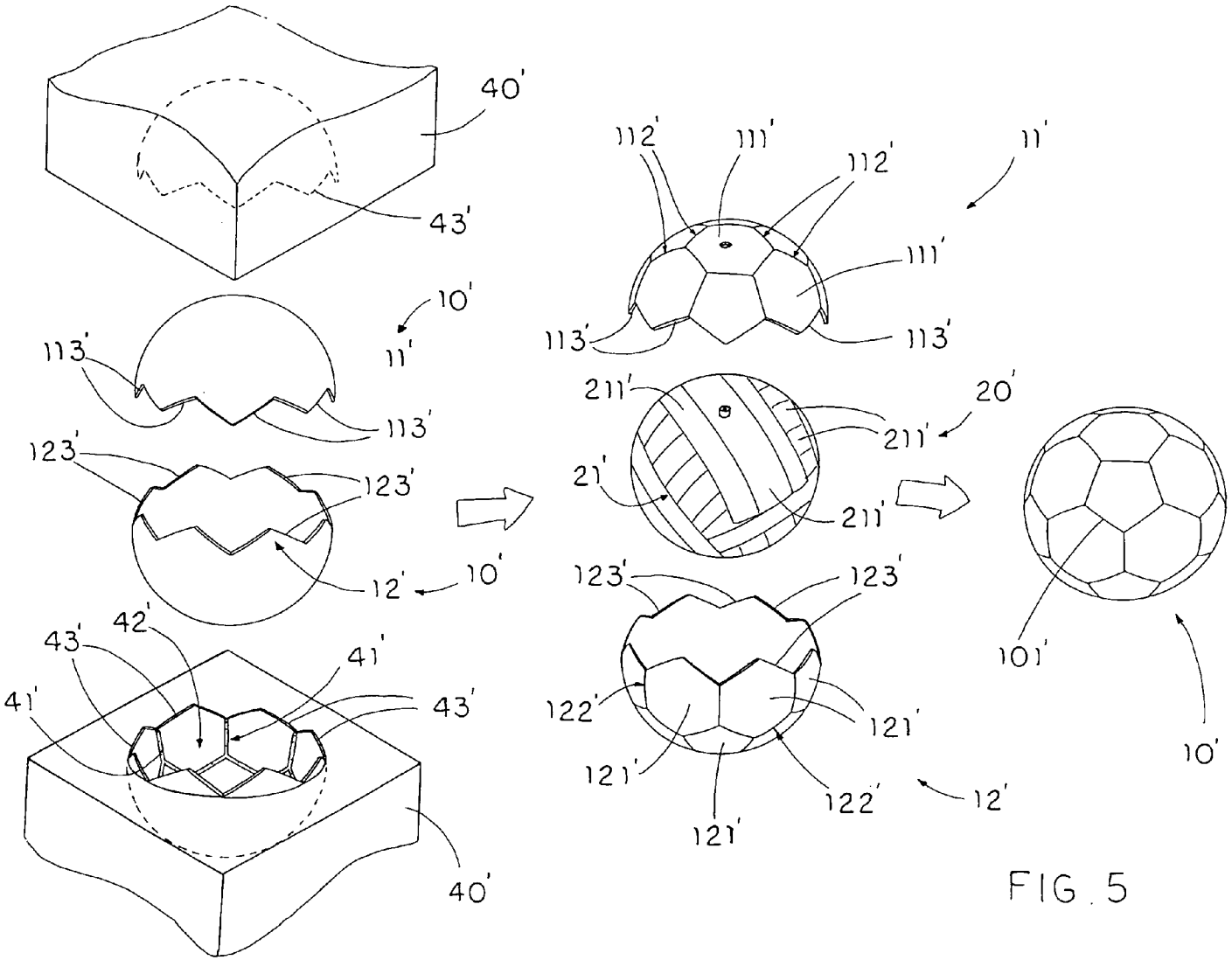
FIG. 5 is a schematic view illustrating the method of manufacturing the sportsball according to the alternative mode of the present invention.

More specifically, each of the molding cups 40' has a plurality of panel guiders 41' integrally protruded from the inner surface of the molding cup 40'. The shape of the contouring edges 113', 123' of the ball shell 11', 12' are still of the shape of the ball panel 111', 121' and the common molding line 101' forms when the two contouring edges 113', 123' merge to one. As can be seen in FIG. 3 and FIG. 5, the common molding line 101' is not structurally identical to the channels 112', 122' because the channels 112', 122' are formed by the panel guiders 41' protruded from the inner surface of the molding cup 40', while the common molding line 101' is formed by merging two contouring edges 113' and 123'. However, when the ball shells 11', 12' engage together with the inflatable bladder 20' therein, the contouring edges 113', 123' merge and form the common molding line 101' aligning with the channels 112', 122' such that the common molding line 101' forms as parts of the channels 112', 122'.

In the preferred embodiment, the inflatable bladder 20' is disposed in the air cavity 100' created by two ball shells 11', 12', wherein the inflatable bladder 20' comprises a bladder body 23' and a construction ball pocket 21' receiving the bladder body 23' therein such that the bladder body 23' is inflated with a predetermined amount of compression air for retaining the shape of the construction ball pocket 21'. Accordingly, the construction ball pocket 21' comprises a plurality of ball pocket leaves 211' integrally boding with each other edge-to-edge to form the construction ball pocket 21'.

Figure 6:
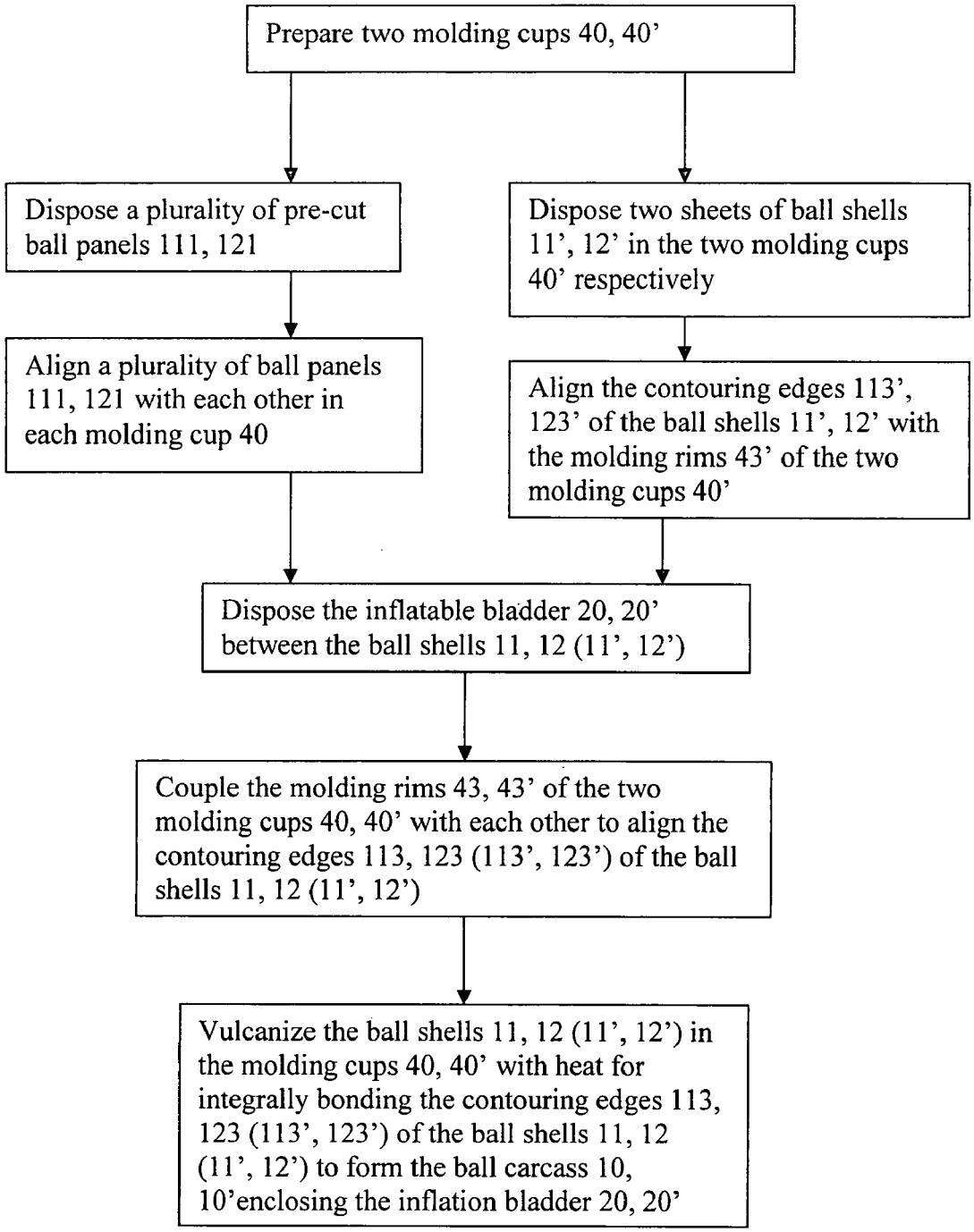
FIG. 6 is a flow chart illustrating the method of manufacturing the sportsball according to the above preferred embodiment of the present invention.

In order to better illustrate the structure of the present invention, it is worth to disclose how to construct the sportsball with hidden molding line. Referring to FIG. 4 to FIG. 6, a method for manufacturing the sportsball with hidden molding edge comprises the following steps.

(1) Prepare two hemispheric molding cups 40, each of the molding cups 40 has an inner surface 42 adapted for an outer surface of one of the ball shells 11, 12 being overlapped thereon and a molding rim 43 encirclingly extended in a serrated manner. Each of the ball shells 11, 12 is made of rubberized molding material.

(2) Provide a plurality of pre-cut ball panels 111, 121 in a predetermined shape and dispose the ball panels into each molding cup 40 to form the ball shell 11, 12, wherein each of the ball panels 111, 121 has one or more connecting edges and one or more free edges.

(3) Align a plurality of ball panels 111, 121 with each other such that when the ball panels 111, 121 are connected with each other edge-to-edge, each of the channels 112, 122 is formed between two connecting edges of every two of the adjacent ball panels 111, 121 while the contouring edge 113, 123 of each of the ball shells 11, 12 is formed along the free edges of the ball panels 111, 121 and is aligned with the molding rim 43 of the molding cup 40. Accordingly, each of the molding cups 40 has a plurality of panel guiders 41 integrally protruded from the inner surface of said respective molding cup 40 to guide the ball panels 111, 121 overlapped thereon.

(4) Dispose the inflatable bladder 20 into the air cavity 100 between the ball shells 11, 12.

(5) Couple the molding rims 43 of the two molding cups 40 with each other to align said contouring edges 113, 123 of the ball shells 11, 12, and the common molding line 101 formed, which is among the channels 112, 122 indented on the outer surface located between every neighboring panel 111, 121.

(6) Vulcanize the ball shells 11, 12 in the molding cups 40 with heat for integrally bonding the contouring edges 113, 123 of the ball shells 11, 12 to form the ball carcass 10 to enclose the inflatable bladder 20. Therefore, the sportsball is formed with the inflatable bladder 20 within the ball carcass 10.

As shown in FIG. 5, the method for manufacturing the sportsball, such as a soccer ball, according to the alternative mode comprises the following steps.

(1) Prepare two hemispheric molding cups 40', each of the molding cups 40 has an inner surface 42' adapted for an outer surface of one of the ball shells 11', 12' being overlapped thereon and a molding rim 43' encirclingly extended in a serrated manner. Accordingly, a sheet of ball panel 111', 121' is pre-cut into a predetermined shape to form the contouring edge 113', 123' as a peripheral edge of the ball panel 111', 121'. In addition, each of the ball shells 11', 12' is made of rubberized molding material.

(2) Dispose two ball shells 11', 12' in the two molding cups 40' respectively, wherein the contouring edges 113', 123' of the ball shells 11', 12' are aligned with the molding rim 43' of the molding cups 40' respectively. Each of the molding cups 40' has a plurality of channel protrusions 41' integrally from the inner surface of the respective molding cup 40' to heat press on the outer surface of the ball shell 11', 12' so as to form an elongated molding mark as each of the channels 112', 122' on the ball shell 11', 12'.

(3) Dispose the inflatable bladder 20' the air cavity 100' between the ball shells 11', 12'.

(4) Couple the molding rims 43' of the two molding cups 40' with each other to align the contouring edges 113', 123' of the ball shells 11', 12', and the common molding line 101' formed, which is among the channels 112', 122' indented on the outer surface located between every neighboring panel 111', 121'.

(5) Vulcanizing the ball shells 11', 12' in the molding cups 40 with heat for integrally bonding the contouring edges 113', 123' of the ball shells 11', 12' to form the ball carcass 10'.

It is worth mentioning that the purpose of vulcanization is to melt rubber to reach its maturity and to form a soccer ball with a smooth surface. It is also worth to mention that the inflatable bladders 20 and 20' are exchangeable in the embodiments of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for manufacturing a sportsball, which comprises the steps of:

(a.1) pre-cutting a plurality of ball panels in a predetermined shape to form two ball shells each having an outer surface and a plurality of channels indented on said outer surface to form a plurality of panel contours thereon, and a contouring edge defining a starting point at one of said channels to continuously extend from said channel to another said adjacent channel until said contouring edge is extended back to said starting point, wherein each of said ball panels has one or more connecting edges and one or more free edges;

(a.2) aligning a plurality of ball panels with each other such that when said ball panels are connected with each other in an edge-to-edge manner, each of said channels is formed between two connecting edges of every two of said adjacent ball panels while said contouring edge of each of said ball shells is formed along said free edges of said ball panels;

(b.1) disposing said two ball shells in two molding cups respectively, wherein each of said molding cups has an inner surface being overlapped with said outer surface of said respective ball shell, a molding rim shaped and sized corresponding to said contouring edge of said respective ball shell, and a plurality of panel guiders integrally protruded from said inner surface of said respective molding cup to guide said ball panels overlapped thereon;

(b.2) coupling said molding rims of said two molding cups with each other to align said contouring edges of said ball shells; and (b.3) vulcanizing said ball shells in said molding cups with heat for integrally bonding said contouring edges of said ball shells to form a ball carcass having an air cavity therein, wherein said contouring edges of said ball shells are alignedly linked to form a common edge of said ball carcass which is a molding line thereof, and to form as said channels of said ball carcass to invisible said molding line thereat, wherein said ball panels are aligned edge-to-edge on said inner surface of said respective molding cup, such that said connecting edges of said ball panels are integrally connected with each other to form each of said ball shells in one piece structure.

2. The method, as recited in claim 1, wherein each of said ball shells is made of rubberized molding material.

3. The method, as recited in claim 1, wherein said step (a.1) further comprises the steps of:

pre-cutting a sheet of ball panel cut into a predetermined shape to form said contouring edge as a peripheral edge of said ball panel; and overlapping said ball panel on said inner surface of said respective molding cup.

4. The method, as recited in claim 2, wherein said step (a.1) further comprises the steps of:

pre-cutting a sheet of ball panel cut into a predetermined shape to form said contouring edge as a peripheral edge of said ball panel; and overlapping said ball panel on said inner surface of said respective molding cup.

5. The method, as recited in claim 1, wherein each of said molding cups has a plurality of channel protrusions integrally formed on said inner surface of said respective molding cup to heat press on said outer surface of said ball shell so as to form an elongated molding mark as each of said channels on said ball shell.

6. The method, as recited in claim 2, wherein each of said molding cups has a plurality of channel protrusions integrally formed on said inner surface of said respective molding cup to heat press on said outer surface of said ball shell so as to form an elongated molding mark as each of said channels on said ball shell.

7. The method, as recited in claim 3, wherein each of said molding cups has a plurality of channel protrusions integrally from said inner surface of said respective molding cup to heat press on said outer surface of said ball shell so as to form an elongated molding mark as each of said channels on said ball shell.

8. The method as recited in claim 1, before said step (b.1) and after said step (a.2), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and at least an elongated strengthened thread evenly wound around an outer surface of said bladder body to form a web layer embracing said bladder body.

9. The method as recited in claim 1, before said step (b.1) and after said step (a.2), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and at least an elongated strengthened thread evenly wound around an outer surface of said bladder body to form a web layer embracing said bladder body.

10. The method as recited in claim 7, before said step (b.1) and after said step (a.2), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and at least an elongated strengthened thread evenly wound around an outer surface of said bladder body to form a web layer embracing said bladder body.

11. The method as recited in claim 1, before the step (b), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and a construction ball pocket receiving said bladder body therein and comprising a plurality of ball pocket leaves integrally bonding with each other edge-to-edge.

12. The method as recited in claim 4, before the step (b), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and a construction ball pocket receiving said bladder body therein and comprising a plurality of ball pocket leaves integrally bonding with each other edge-to-edge.

13. The method as recited in claim 7, before the step (b), further comprising a step of disposing an inflatable bladder disposed within said ball shells to receive said inflatable bladder in said air cavity for propping up and supporting said ball carcass, wherein said inflatable bladder comprises a bladder body for retaining a predetermined amount of air therein, and a construction ball pocket receiving said bladder body therein and comprising a plurality of ball pocket leaves integrally bonding with each other edge-to-edge.

* * * * *